US008727855B2

(12) United States Patent
Williams et al.

(10) Patent No.: US 8,727,855 B2
(45) Date of Patent: May 20, 2014

(54) THREE-DIMENSIONAL PAYLINES FOR GAMING MACHINES

(75) Inventors: David C. Williams, Carson City, NV (US); Joseph Randy Hedrick, Reno, NV (US); Kurt M. Larsen, Reno, NV (US)

(73) Assignee: IGT, Las Vegas, NV (US)

( * ) Notice: Subject to any disclaimer, the term of this patent is extended or adjusted under 35 U.S.C. 154(b) by 57 days.

(21) Appl. No.: 11/938,184

(22) Filed: Nov. 9, 2007

(65) Prior Publication Data

US 2008/0113775 A1 May 15, 2008

Related U.S. Application Data

(60) Provisional application No. 60/858,741, filed on Nov. 13, 2006.

(51) Int. Cl.

| | |
|---|---|
| ***G06F 17/00*** | (2006.01) |
| ***G07F 17/32*** | (2006.01) |
| *G07F 17/34* | (2006.01) |

(52) U.S. Cl.

CPC ..... *G07F 17/32* (2013.01); *G07F 17/3211* (2013.01); *G07F 17/326* (2013.01); *G07F 17/34* (2013.01)

USPC ..... 463/16; 463/20

(58) Field of Classification Search

CPC ..... G07F 17/32; G07F 17/34; G07F 17/3211; G07F 17/326

USPC ..... 463/16–20

See application file for complete search history.

(56) References Cited

U.S. PATENT DOCUMENTS

| | | | |
|---|---|---|---|
| 3,708,219 | A | 1/1973 | Forlini et al. |
| 4,333,715 | A | 6/1982 | Brooks |
| 4,517,558 | A | 5/1985 | Davids |
| 4,607,844 | A | 8/1986 | Fullerton |

(Continued)

FOREIGN PATENT DOCUMENTS

| | | |
|---|---|---|
| AU | 775882 B2 | 11/2000 |
| EP | 0 454 423 | 10/1991 |

(Continued)

OTHER PUBLICATIONS

"SPD," Malvino Inc., www.malvino.com, Jul. 19, 1999, 10 pages.

(Continued)

*Primary Examiner* — Michael Cuff
(74) *Attorney, Agent, or Firm* — Foley & Lardner LLP

(57) ABSTRACT

Gaming machines, systems and methods for presenting wager-based games having three-dimensional paylines are disclosed. Gaming machines include an exterior housing, master gaming controller, display device, speakers and a network interface. A multi-layer display device that presents three-dimensional paylines includes a display controller that generates or transmits display signals, a first display screen that presents a first visual display and a second display screen that presents a second visual display, where the second display screen is positioned behind the first display screen such that the first and second visual displays combine for a single visual presentation. Each of the first and second visual displays includes symbols, symbol portions, stops and/or designations used to form a three-dimensional payline. A three-dimensional payline can jump from one display screen to the other at least once. Three-dimensional payline symbols can be composite symbols that are formed on a plurality of display screens.

9 Claims, 8 Drawing Sheets

(56) References Cited

U.S. PATENT DOCUMENTS 4,621,814 A 11/1986 Stephen et al.
4,659,182 A 4/1987 Aizawa
4,718,672 A 1/1988 Okada
4,856,787 A 8/1989 Itkis
4,911,449 A 3/1990 Dickinson et al.
4,912,548 A 3/1990 Shanker et al.
5,086,354 A 2/1992 Bass et al.
5,113,272 A 5/1992 Reamey
5,132,839 A 7/1992 Travis
5,319,491 A 6/1994 Selbrede
5,342,047 A 8/1994 Heidel et al.
5,364,100 A 11/1994 Ludlow et al.
5,375,830 A 12/1994 Takemoto et al.
5,376,587 A 12/1994 Buchmann et al.
5,393,061 A 2/1995 Manship et al.
5,467,893 A 11/1995 Landis, II et al.
5,539,547 A 7/1996 Ishii et al.
5,580,055 A 12/1996 Hagiwara
5,585,821 A 12/1996 Ishikura et al.
5,589,980 A 12/1996 Bass et al.
5,745,197 A 4/1998 Leung et al.
5,752,881 A 5/1998 Inoue
5,764,317 A 6/1998 Sadovnik et al.
5,910,046 A 6/1999 Wada et al.
5,951,397 A 9/1999 Dickinson
5,956,180 A 9/1999 Bass et al.
5,967,893 A 10/1999 Lawrence et al.
6,001,016 A 12/1999 Walker et al.
6,015,346 A 1/2000 Bennett
6,027,115 A 2/2000 Griswold et al.
6,050,895 A 4/2000 Luciano et al.
6,054,969 A 4/2000 Haisma
6,059,658 A 5/2000 Mangano et al.
6,135,884 A 10/2000 Hedrick et al.
6,159,098 A 12/2000 Slomiany et al.
6,213,875 B1 4/2001 Suzuki
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,315,666 B1 11/2001 Mastera et al.
6,337,513 B1 1/2002 Clevenger et al.
6,347,996 B1 2/2002 Gilmore et al.
6,368,216 B1 4/2002 Hedrick et al.
6,379,244 B1 4/2002 Sagawa et al.
6,398,220 B1 6/2002 Inoue
6,416,827 B1 7/2002 Chakrapani et al.
6,444,496 B1 9/2002 Edwards et al.
6,445,185 B1 9/2002 Damadian et al.
6,491,583 B1 12/2002 Gauselmann
6,503,147 B1 1/2003 Stockdale et al.
6,511,375 B1 1/2003 Kaminkow
6,512,559 B1 1/2003 Hashimoto et al.
6,514,141 B1 2/2003 Kaminkow et al.
6,517,433 B2 2/2003 Loose et al.
6,517,437 B1 2/2003 Wells et al.
6,547,664 B2 4/2003 Saunders
6,575,541 B1 6/2003 Hedrick et al.
6,585,591 B1 7/2003 Baerlocher et al.
D480,961 S 10/2003 Deadman
6,646,695 B1 11/2003 Gauselmann
6,652,378 B2 11/2003 Cannon et al.
6,659,864 B2 12/2003 McGahn et al.
6,661,425 B1 12/2003 Hiroaki
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,802,777 B2 10/2004 Seelig et al.
6,817,945 B2 11/2004 Seelig et al.
6,817,946 B2 11/2004 Motegi et al.
6,887,157 B2 5/2005 LeMay et al.
6,890,259 B2 5/2005 Breckner et al.
6,906,762 B1 6/2005 Witehira et al.
6,937,298 B2 8/2005 Okada
7,095,180 B2 8/2006 Emslie et al.
7,097,560 B2 8/2006 Okada
7,128,647 B2 10/2006 Muir
7,159,865 B2 1/2007 Okada
7,160,187 B2 1/2007 Loose et al.
7,204,753 B2 4/2007 Ozaki et al.
7,207,883 B2 4/2007 Nozaki et al.
7,220,181 B2 5/2007 Okada
7,252,288 B2 8/2007 Seelig et al.
7,252,591 B2 * 8/2007 Van Asdale ..... 463/22
7,255,643 B2 8/2007 Ozaki et al.
7,309,284 B2 12/2007 Griswold et al.
7,322,884 B2 1/2008 Emori et al.
7,329,181 B2 2/2008 Hoshino et al.
7,510,475 B2 * 3/2009 Loose et al. ..... 463/31
7,918,734 B2 4/2011 Gould
8,029,351 B2 10/2011 Kosaka et al.
8,131,649 B2 3/2012 Yen et al.
8,357,033 B2 * 1/2013 Williams et al. ..... 463/20
2001/0013681 A1 8/2001 Bruzzese et al.
2002/0045472 A1 4/2002 Adams
2002/0173354 A1 11/2002 Winans et al.
2002/0183105 A1 12/2002 Cannon et al.
2003/0027624 A1 2/2003 Gilmore et al.
2003/0032478 A1 2/2003 Takahama et al.
2003/0032479 A1 2/2003 LeMay et al.
2003/0064781 A1 * 4/2003 Muir ..... 463/20
2003/0083943 A1 5/2003 Adams et al.
2003/0087690 A1 5/2003 Loose et al.
2003/0130028 A1 7/2003 Aida et al.
2003/0176214 A1 9/2003 Burak et al.
2003/0222876 A1 12/2003 Giemborek et al.
2003/0236114 A1 12/2003 Griswold et al.
2004/0023714 A1 2/2004 Asdale
2004/0029636 A1 2/2004 Wells
2004/0063490 A1 4/2004 Okada
2004/0066475 A1 4/2004 Searle
2004/0087360 A1 5/2004 Chamberlain et al.
2004/0116178 A1 6/2004 Okada
2004/0147303 A1 7/2004 Imura et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192430 A1 9/2004 Burak et al.
2004/0198485 A1 10/2004 Loose et al.
2004/0207154 A1 10/2004 Okada
2004/0208126 A1 10/2004 Wassew et al.
2004/0209666 A1 10/2004 Tashiro
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0224747 A1 11/2004 Okada
2004/0233663 A1 11/2004 Emslie et al.
2004/0239582 A1 12/2004 Seymour
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0062410 A1 3/2005 Bell et al.
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0192090 A1 9/2005 Muir et al.
2005/0193269 A1 9/2005 Haswell et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0266912 A1 12/2005 Sekiguchi

(56) References Cited

U.S. PATENT DOCUMENTS

| | | | | |
|---|---|---|---|---|
| 2005/0285337 | A1 | 12/2005 | Durham et al. | |
| 2006/0100014 | A1 | 5/2006 | Griswold et al. | |
| 2006/0103951 | A1 | 5/2006 | Bell et al. | |
| 2006/0125745 | A1 | 6/2006 | Evanicky | |
| 2006/0166727 | A1 | 7/2006 | Burak | |
| 2006/0191177 | A1 | 8/2006 | Engel | |
| 2006/0284574 | A1 | 12/2006 | Emslie et al. | |
| 2006/0290594 | A1 | 12/2006 | Engel et al. | |
| 2007/0004510 | A1 | 1/2007 | Underdahl et al. | |
| 2007/0004513 | A1 | 1/2007 | Wells et al. | |
| 2007/0010315 | A1 | 1/2007 | Hein | |
| 2007/0024002 | A1 | 2/2007 | McMain et al. | |
| 2007/0105628 | A1 * | 5/2007 | Arbogast et al. | 463/42 |
| 2007/0243934 | A1 | 10/2007 | Little et al. | |
| 2008/0008188 | A1 | 1/2008 | Buga et al. | |
| 2008/0020816 | A1 | 1/2008 | Griswold et al. | |
| 2008/0020839 | A1 | 1/2008 | Wells et al. | |
| 2008/0020840 | A1 | 1/2008 | Wells et al. | |
| 2008/0020841 | A1 | 1/2008 | Wells et al. | |

FOREIGN PATENT DOCUMENTS

| | | | |
|---|---|---|---|
| EP | 0 484 103 | | 5/1992 |
| EP | 0 997 857 | | 10/1999 |
| EP | 1 260 928 | | 11/2002 |
| EP | 1 282 088 | | 2/2003 |
| EP | 1 462 152 | A2 | 9/2004 |
| GB | 1 464 896 | | 2/1977 |
| JP | 2004-220276 | | 8/1992 |
| JP | 06-043425 | | 2/1994 |
| JP | 07-124290 | | 5/1995 |
| JP | 2000-300729 | | 10/2000 |
| JP | 2000-350805 | | 12/2000 |
| JP | 2001-062032 | | 3/2001 |
| JP | 2001-238995 | | 9/2001 |
| JP | 2001-252393 | | 9/2001 |
| JP | 2001-252394 | | 9/2001 |
| JP | 2002-085624 | | 3/2002 |
| JP | 2004-089707 | | 3/2004 |
| JP | 2004-105616 | | 4/2004 |
| JP | 2004-166879 | | 6/2004 |
| JP | 2005-253561 | | 9/2005 |
| JP | 2005-266387 | | 9/2005 |
| JP | 2005-266388 | | 9/2005 |
| JP | 2005-274906 | | 10/2005 |
| JP | 2005-274907 | | 10/2005 |
| JP | 2005-283864 | | 10/2005 |
| JP | 2006-346226 | | 12/2006 |
| WO | 99/42889 | | 8/1999 |
| WO | 99/44095 | | 9/1999 |
| WO | 01/15127 | | 3/2001 |
| WO | 01/15128 | | 3/2001 |
| WO | 01/15132 | | 3/2001 |
| WO | 01/09664 | | 8/2001 |
| WO | 03/039699 | | 5/2003 |
| WO | 2004/001486 | | 12/2003 |
| WO | 2004/102520 | | 11/2004 |
| WO | 2006/034192 | | 3/2006 |
| WO | WO-2006/033986 | A1 | 3/2006 |
| WO | 2006/038819 | | 4/2006 |
| WO | WO-2007/032916 | A1 | 3/2007 |
| WO | WO-2007/120444 | A1 | 10/2007 |

OTHER PUBLICATIONS

Bosner, "How Smart Windows Work," HowStuffWorks, Inc.,www.howstuffworks.com, 1998-2004, 9 pages.
Exam Report dated Sep. 21, 2007 from European Application No. 05 705 315.9.
Novel 3-D Video Display Technology Developed, News release: Aug. 30, 1996, www.eureckalert.org/summaries/1199.html, printed from Internet Archive using date Sep. 2, 2000.
Saxe et al., "Suspended-Particle Devices," www.refr-spd.com, Apr./May 1996, 5 pages.
Time Multiplexed Optical Shutter (TMOS): A revolutionary Flat Screen Display Technology, www.vea.com/TMOS.html, Apr. 8, 1999, printed from Internet Archive using date Oct. 6, 1999.
Time Multiplexed Optical Shutter (TMOS): A revolutionary Flat Screen Display Technology, www.tralas.com/TMOS.html, Apr. 5, 2001, printed from Internet Archive using date Apr. 11, 2001.
U.S. Appl. No. 11/938,086, filed Nov. 9, 2007.
U.S. Appl. No. 11/877,611, filed Oct. 23, 2007.
Office Action dated Aug. 29, 2007 from U.S. Appl. No. 10/755,598.
Office Action dated Oct. 31, 2007 from U.S. Appl. No. 10/213,626.
Final Office Action dated Mar. 28, 2007 from U.S. Appl. No. 10/213,626.
Office Action dated Apr. 27, 2006 from U.S. Appl. No. 10/213,626.
Final Office Action dated Jan. 10, 2006 from U.S. Appl. No. 10/213,626.
Office Action dated Aug. 31, 2004 from U.S. Appl. No. 10/213,626.
"Light Valve". [online] [retrieved on Nov. 15, 2005]. Retrieved from the Internet URL http://www.meko.co.uk/lightvalve.shtml (1 page).
"Liquid Crystal Display". [online]. [retrieved on Nov. 16, 2005]. Retrieved form the Internet URL http://en.wikipedia.org/wiki/LCD (6 pages).
Bonsor, Kevin, "How Smart Windows Will Work," Howstuffworks, Inc. 1998-2002, http://www/howstuffworks.com/smart-window.htm/printable. Printed Nov. 25, 2002 (5 pages).
"What is SPD?" SPD Systems, Inc. 2002, http://www.spd-systems.com/spdq.htm. Printed Dec. 4, 2002 (2 pages).
"Debut of the Let's Make a Deal Slot Machine," Let's Make a Deal 1999-2002, http:///www.letsmakeadeal.com/pr01.htm. Printed Dec. 3, 2002 (2 pages).
U.S. Appl. No. 11/849,119, filed Aug. 31, 2007.
U.S. Appl. No. 11/858,695, filed Sep. 20, 2007.
U.S. Appl. No. 11/858,845, filed Sep. 20, 2007.
U.S. Appl. No. 11/858,849, filed Sep. 20, 2007.
U.S. Appl. No. 11/859,127, filed Sep. 21, 2007.
U.S. Appl. No. 11/938,151, filed Nov. 9, 2007.

* cited by examiner

THREE-DIMENSIONAL PAYLINES FOR GAMING MACHINES

CROSS REFERENCE TO RELATED APPLICATION

This application claims priority to U.S. Provisional Patent Application No. 60/858,741, filed on Nov. 13, 2006, which is incorporated herein by reference in its entirety and for all purposes.

TECHNICAL FIELD

The present invention relates generally to wager-based gaming machines, and more specifically to the use of three-dimensional paylines on such wager-based gaming machines.

BACKGROUND

Casinos and other similar venues make up a growing multi-billion dollar gaming industry. As technology in the gaming industry progresses, traditional mechanically driven reel slot machines are steadily being replaced by electronic machines having a liquid crystal display ("LCD") and/or other similar display. Processor-based gaming machines are becoming the norm. One reason for their increased popularity is the nearly endless variety of games that can be implemented using processor-based technology. The processor-based gaming machines permit the operation of more complex games, advance player tracking, improve security, permit wireless communications, and add a host of digital features that are not be possible on mechanical-driven gaming machines. Many of these newer processor-based gaming machines provide various types of reel-based games that simulate or are at least similar to the reel-based games provided on older mechanically driven machines.

A "mechanical reel" type gaming machine can refer to a slot machine having traditional rotating reels with various associated latches and mechanical parts. A mechanical reel usually has a fixed number of reel symbols disposed about a reel strip that is attached about the edge circumference of a wheel, such that the outer edge of the "reel" is viewed. In a purely mechanical gaming machine, a motor, spring, or other mechanical system physically rotates or spins the reel until it stops at a particular rotational position or "reel stop," and a particular reel symbol rests in view of a player to indicate an outcome for that reel for that given reel game. In many older machines, the reels were spun by potential energy first stored in a spring-loaded mechanism wound and then actuated by the pull of a traditional pull-arm handle. Each reel was stopped at a random position by a mechanical device. The slot machine sensed a combined reel outcome, usually along a central payline, by sensing the physical position of each reel. A payout could then be made to the player if the combined outcome was a winning combination.

Later versions of such gaming machines include "electromechanical" reel type gaming machines. Such electromechanical reel type gaming machines could include the same or similar physical rotating reels, with the starting, spinning and stopping of each such electromechanical reel being controlled by a stepper motor. One or more microprocessors are used to control the various reel stepper motors. The use of microprocessors and stepper motors generally allows for a wide expansion of "virtual" reel stops for each rotating reel, such that larger payouts and jackpots can be realized over purely mechanical reel type gaming machines. Still further versions include fully electronic or processor based gaming machines that are adapted to present "virtual" or simulated reels on one or more visual or video displays. These electronic or processor-based gaming machines are becoming the norm due to a variety of factors, such as their increased versatility and general appeal to players.

In a typical electronic gaming machine, a game play is initiated through a player wager of money or credit, whereupon the gaming machine determines a game outcome, presents the game outcome to the player and then potentially dispenses an award of some type, including a monetary award, depending upon the game outcome. Electronic and microprocessor based gaming machines can include a variety of hardware and software components to provide a wide variety of game types and game playing capabilities, with such hardware and software components being generally well known in the art. A typical electronic gaming machine can include hardware devices and peripheral such as bill validators, coin acceptors, card readers, keypads, buttons, levers, touch screens, coin hoppers, player tracking units and the like. In addition, each gaming machine can have various audio and visual display components that can include, for example, speakers, display panels, belly and top glasses, exterior cabinet artwork, lights, and top box dioramas, as well as any number of video displays of various types to show game play and other assorted information.

Advances in technology have resulted in processor-based gaming machines that are increasingly better at simulating or emulating actual mechanical reels from a mechanical or electromechanical reel-based gaming machine. Various efforts to simulate or realistically emulate mechanical reels on a video screen of a processor-based gaming machine abound. Some of such efforts can be found at, for example, U.S. Pat. No. 6,887,157, entitled "Virtual Camera and 3-D Gaming Environments in a Gaming Machine," as well as at Japanese Patent Publication No. 2006346226A2, entitled "Game Device and Game Program." Another reference that involves rotating reel games having processors is U.S. Patent Publication No. 2005/0285337, entitled "Dynamic Generation of a Profile for Spinning Reel Gaming Machines," and there are numerous other known instances of machines and systems involving rotating reel games that are controlled at least in part by a microprocessor.

While existing designs and systems for providing realistic and entertaining reel-type games on processor-based gaming machines have been adequate in the past, improvements are usually welcomed and encouraged. In light of the foregoing, it is desirable to develop improved processor-based gaming machines that provide even further features for simulated reel type games played thereupon.

SUMMARY

It is an advantage of the present invention to provide processor-based gaming machines that are adapted to present reel type games thereupon, such that the presented games include three-dimensional paylines. This can be accomplished at least in part through the use of simulated or "virtual" gaming reels that are presented on multiple display screens of a specialized multi-layer display at a respective gaming machine or gaming terminal.

In various embodiments of the present invention, a processor-based gaming machine adapted for accepting a wager, playing a game based on the wager and granting a payout based on the result of the game is provided. The gaming machine can include an exterior housing arranged to contain various internal gaming machine components therein, a master gaming controller in communication with various internal gaming machine components and adapted to execute or control one or more aspects of the wager based game, and a display device in communication with the master gaming controller and adapted to present one or more three-dimensional payline thereupon. Added components can include one or more speakers in communication with said master gaming controller and adapted to present sounds with respect to a three-dimensional payline, as well as a network interface coupling the gaming machine to one or more remotely located networked components, wherein the network interface is adapted to facilitate the downloading of three-dimensional payline parameters, three-dimensional payline games, or both to the gaming machine.

The display device can be a multi-layer display that includes at least one display controller adapted to generate or transmit one or more display signals, a first display screen in communication with the display controller and adapted to present a first visual display thereupon based on the display signal or signals, and a second display screen in communication with the display controller and adapted to present a second visual display thereupon based upon the display signal or signals. The second display screen can be positioned behind the first display screen such that the first and second visual displays are adapted to combine for a single visual presentation that includes a three-dimensional payline to a player of the wager-based game. In particular, each three-dimensional payline can include a plurality of symbols, symbol portions, stops, designations or any combination thereof, at least one of which is displayed on the first display screen and at least another of which is disposed on the second display screen.

In various embodiments, one or more three-dimensional paylines can move or jump at least once from one of the multi-layer display screens to another multi-layer display screen. Multiple moves, jumps or extensions between display screens are also possible for a given three-dimensional payline. One or more three-dimensional paylines can have a depth component to go along with a horizontal component and/or a vertical component with respect to a player of the gaming machine. Such a depth component can result from the three-dimensional payline moving or jumping toward or away from the player viewing the multi-layer display.

In some embodiments a three-dimensional payline can include a plurality of reel stops, reel symbols or both disposed across a plurality of virtual reels, while in other embodiments a three-dimensional payline can include a plurality of wheel stops, wheel symbols or both disposed across a plurality of virtual wheels. A combination of virtual reels and wheel may also be used. In some embodiments using virtual reels, a first virtual reel can be displayed on the first display screen and a second virtual reel can be displayed on the second display screen. In other embodiments using virtual reels, all virtual reels can be displayed on only one of the multi-layer display screens, while another multi-layer display screen displays one or more additional game designations that are used with respect to the displayed virtual reels within the context of a wager-based game. Such one or more additional game designations can includes a "wild" or "multiplier" designation for a corresponding reel symbol, reel stop, payline or any combination thereof, and a player may be required to provide an added payment or wager for the additional game designation or designations to be effective for a given wager-based game.

In various embodiments, which can include one or more of the foregoing features, one or more three-dimensional paylines can include at least one composite reel symbol or wheel symbol, with such a composite reel symbol or wheel symbol having a first symbol portion displayed on the first display screen and a second symbol portion displayed on the second display screen to form a combined reel symbol or wheel symbol having a three-dimensional effect.

Still further embodiments include various methods of presenting a three-dimensional payline. Method steps can include providing a wager-based gaming having a multi-layer display device, accepting a monetary value wager from a player, accepting a game-related input from the player, initiating the play of a wager-based game as a result of the game-related input, determining a first three-dimensional payline for use with the wager-based game, and presenting on the multi-layer display the play of the wager-based game including the first three-dimensional payline. The multi-layer display device can include a first display screen adapted to present a first visual display thereupon and a second display screen adapted to present a second visual display thereupon, with the second display screen being positioned behind the first display screen such that the first and second visual displays are adapted to combine for a single visual presentation that includes the first three-dimensional payline to the player. The first three-dimensional payline can include a plurality of symbols, symbol portions, stops, designations or any combination thereof, at least one of which is displayed on the first display screen and at least another of which is disposed on the second display screen. The method may also include the steps of determining a second three-dimensional payline for use with the wager-based game, displaying the second three-dimensional payline, determining a game outcome, and/or granting a monetary award to the player based on the game outcome.

In various further embodiments, a wager-based gaming system includes a plurality of processor-based gaming machines and a remote host in communication therewith. The processor-based gaming machines can be adapted for accepting a wager, playing a game based on the wager and granting a payout based on the result of the game, and each of the processor-based gaming machines can include an exterior housing arranged to contain a plurality of internal gaming machine components therein, a master gaming controller in communication with at least one of the plurality of internal gaming machine components and adapted to execute or control one or more aspects of a wager-based game, and a multi-layer display device in communication with the master gaming controller and adapted to display a first three-dimensional payline thereupon. The remote host can be adapted to download one or more three-dimensional payline parameters, three-dimensional payline games, or both, to one or more of the processor-based gaming machines.

Other embodiments include just a three-dimensional payline, which can include a first stop located at a first gaming position, a second stop located at a second gaming position, and a third stop located at a third gaming position, such that the first, second and third stops are arranged in a designated order to form a line and provide a wager-based game outcome therefore. Such a line can include a horizontal component, a vertical component and a depth component with respect to a player of the wager-based game. The first, second and third stops can comprise reel stops for virtual reels or wheel stops for virtual wheels. Further, the three-dimensional payline can be displayed on a wager-based gaming machine having a multi-layer display.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive three-dimensional paylines and methods of presentation therefor.

DETAILED DESCRIPTION

Exemplary applications of apparatuses and methods according to the present invention are described as follows. These examples are being provided solely to add context and aid in the understanding of the invention. It will be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as definitive or limiting in scope or setting. Although these examples are described in sufficient detail to enable one skilled in the art to practice the invention, it will be understood that they are not limiting, such that other embodiments may be used and changes may be made without departing from the spirit and scope of the invention.

Described herein are various processor-based gaming machines and systems that present simulated spinning or rotating reels in a manner such that three-dimensional paylines can be created and used with such reels. It will be understood, however, that such three-dimensional paylines can be used with other gaming devices and arrangements other than rotating reels. For example, a plurality of spinning wheels may be used instead of or in conjunction with rotating reels. Such a plurality of spinning wheels may overlap and/or be concentric, and paylines across such a plurality of spinning wheels may also be made three-dimensional. In general, while the use of a rotating gaming reel tends to involve the sideways presentation of the reel, such that its outer edge is viewed, the use of a spinning gaming wheel tends to involve a frontal presentation of the wheel, such that a wheel face is viewed. Thus, while reel symbols or designations on a rotating gaming reel generally appear to move in a linear direction with respect to the player, wheel symbols or designations on a spinning gaming wheel generally appear to move in a circular direction with respect to the player. Other suitable applications of three-dimensional paylines may also be used, as will be readily appreciated from the following description and accompanying figures.

Gaming Machines

Figure 1:
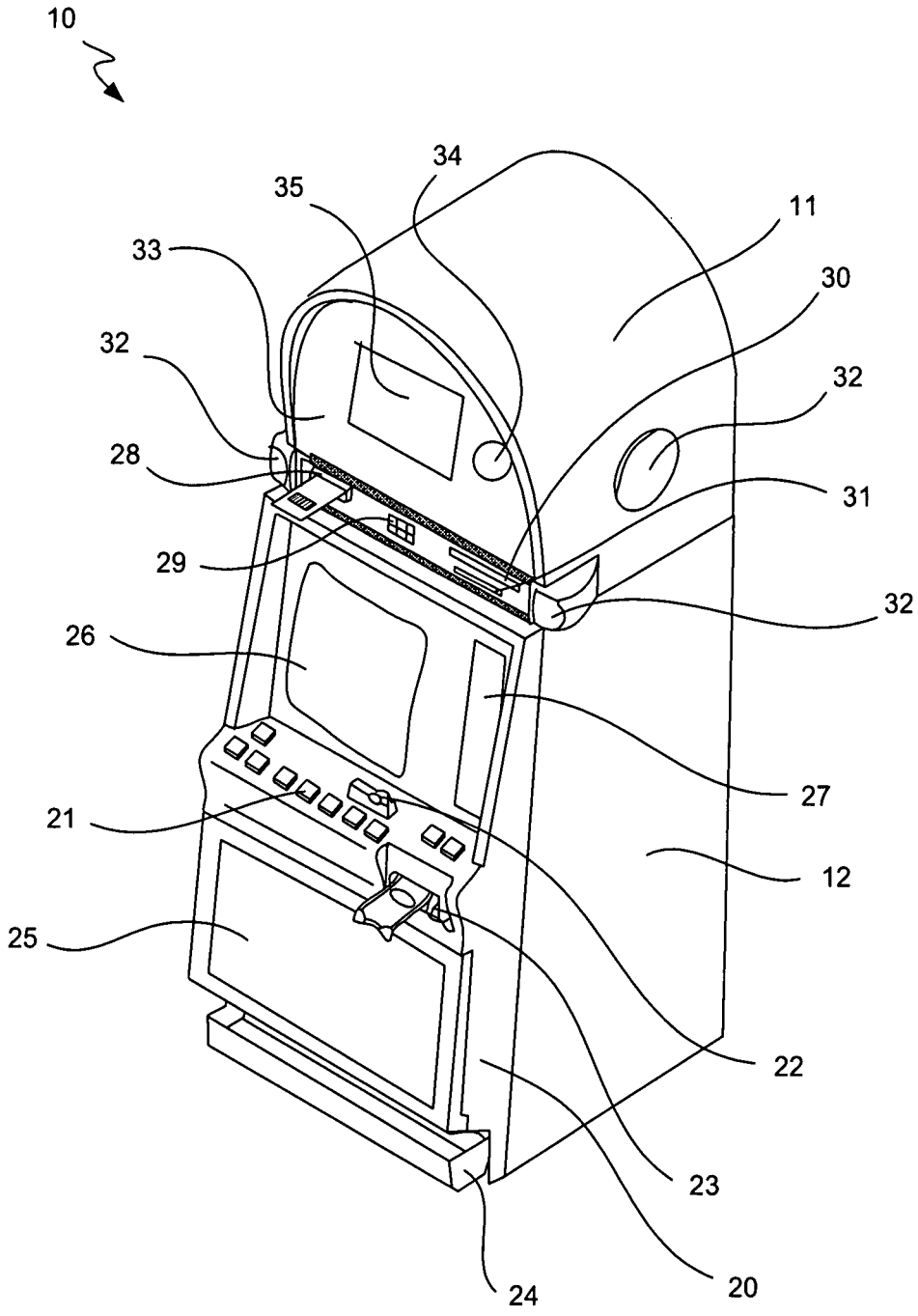
FIG. 1 illustrates in perspective view an exemplary gaming machine.

Referring first to FIG. 1, an exemplary processor-based gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, which collectively form a button panel, one or more money or credit acceptors, such as a coin acceptor 22 and a bill or ticket validator 23, a coin tray 24, and a belly glass 25. Viewable through main door 20 is a primary video display monitor 26 adapted to present a game and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above. In particular, gaming machine 10 can be any of a wide variety of gaming machines manufactured and/or distributed by IGT.

With respect to the basic gaming functionalities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions. In various preferred embodiments, gaming machine 10 can be adapted to present a video simulation of a reel based slots game involving a plurality of gaming reels.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the associated computer system may result. Though most modern general-purpose computers include voltage-monitoring circuitry, these types of circuits only report voltage status to the operating software. Out of tolerance voltages can cause software malfunction, creating a potential unanticipated and/or undesirable condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, USB, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security-monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

General Gaming Network and System Configurations

Figure 2:
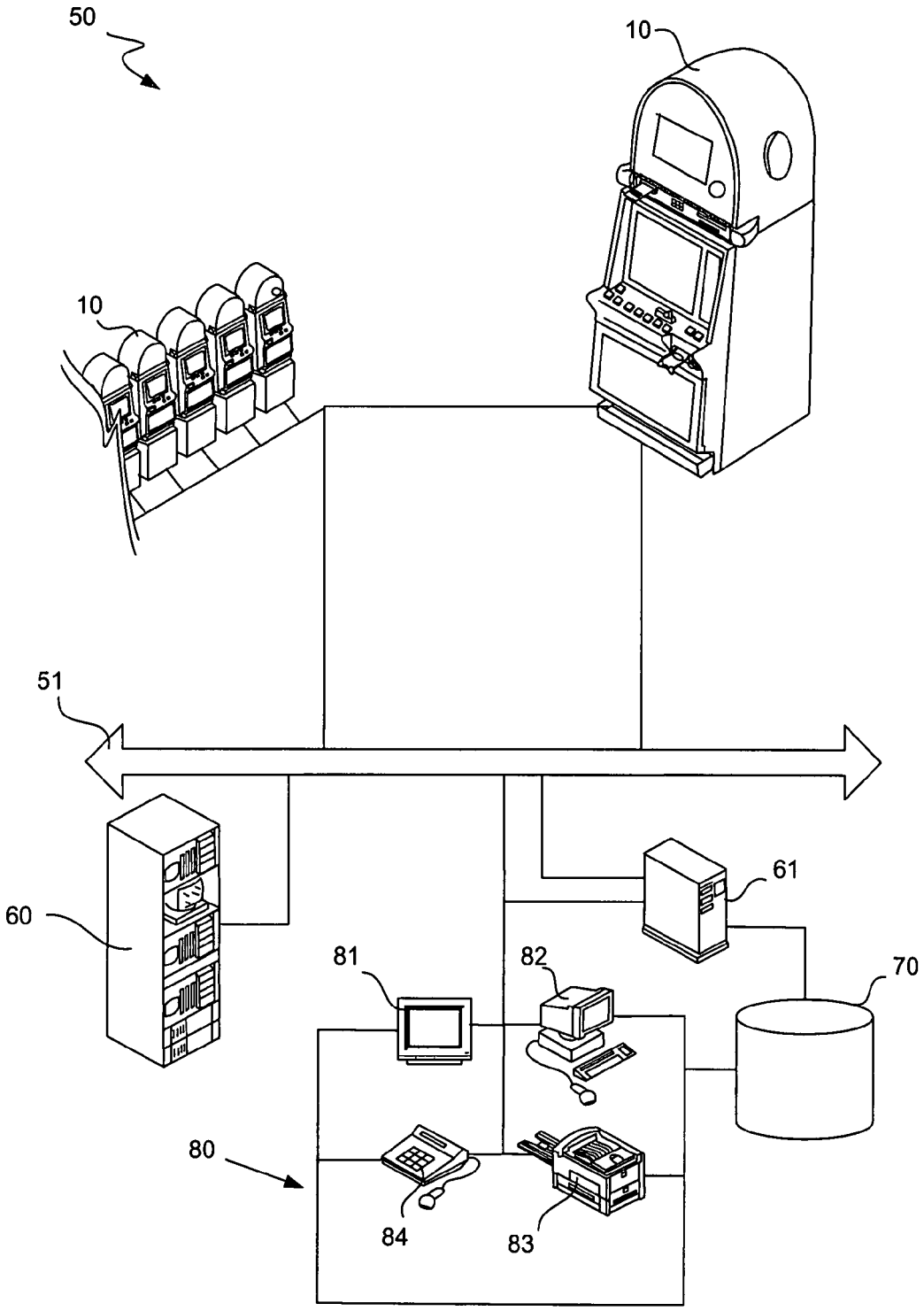
FIG. 2 illustrates in block diagram format an exemplary network infrastructure for providing a gaming system having one or more gaming machines.

Continuing with FIG. 2, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 61, a sub-network of peripheral devices 80, and/or a database 70.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of gaming machine administration and operation under the present methods and systems. Such a special-purpose server or servers could include, for example, a cashless gaming server, a player verification server, a general game server, a downloadable game server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or demarcate some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 61 or another similar component within a general-purpose server 60 also preferably includes a connection to a database or other suitable storage medium 70. Database 70 is preferably adapted to store many or all files containing pertinent data or information for a particular purpose, such as, for example, data regarding visual image data, video clips, other displayable items, and/or related data, among other potential items. Downloadable games having three-dimensional payline applications may also be stored at database 70. Files, data and other information on database 70 can be stored for backup purposes, and are preferably accessible at one or more system locations, such as at a general-purpose server 60, a special purpose server 61 and/or a cashier station or other sub-network location 80, as desired.

In some embodiments, one or both of general-purpose server 60 and special purpose server 61 can be adapted to download various games to one or more gaming machines 10. Such downloaded games can include three-dimensional payline applications, such as those that can be used with rotating reel type games. In addition to three-dimensional paylines, reel type games that can be downloaded may contain various virtual reels, reel symbols and reel stop locations for such symbols being downloaded to the gaming machine or machines 10. Downloaded games can also include wheel-based games and/or other game types, as may be suitable for any applicable three-dimensional paylines. Such downloads can occur based on a request or command from a player or a casino operator, or can take place in an automated fashion by system 50, such as via a particular prompt or trigger.

While gaming system 50 can be a system that is specially designed and created new for use in a casino or gaming establishment, it is also possible that many items in this system can be taken or adopted from an existing gaming system. For example, gaming system 50 could represent an existing cashless gaming system or downloadable gaming system to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 70, specialized server 61 and/or general-purpose server 60, as desired. Other modifications to an existing system may also be necessary, as might be readily appreciated.

While gaming machine 10 can typically be adapted for live game play with a physically present player, it is also contemplated that such a gaming machine may also be adapted for game play with a player at a remote gaming terminal. Other features, functions and devices may also be used in association with gaming machine 10, and it is contemplated that the present invention can be used in conjunction with a gaming machine or device that might encompass any or all such additional types of features, functions and devices. One item that is specifically contemplated for use with the present invention involves a specialized gaming machine or system adapted for the play of wager-based games that incorporate three-dimensional paylines, as described in greater detail below.

General Payline Applications

As is generally known in the art, a payline for a reel-type game on a wager-based gaming machine involves a designated order of consecutive reel stops on a plurality of gaming reels. Reel symbols and/or blanks that wind up on such a payline at the end of a given reel-type game typically result in a game outcome for that payline for a that reel game played on the gaming machine, which game outcome may or may not result in a win or payout to a player. Early paylines were typically only straight lines that moved in a single dimension or direction (i.e., horizontal) across all gaming reels on the gaming machine, while later developments included paylines that might also move diagonally and even zig-zag within two dimensions (i.e, horizontal and vertical) across the gaming reels.

Figure 3A:
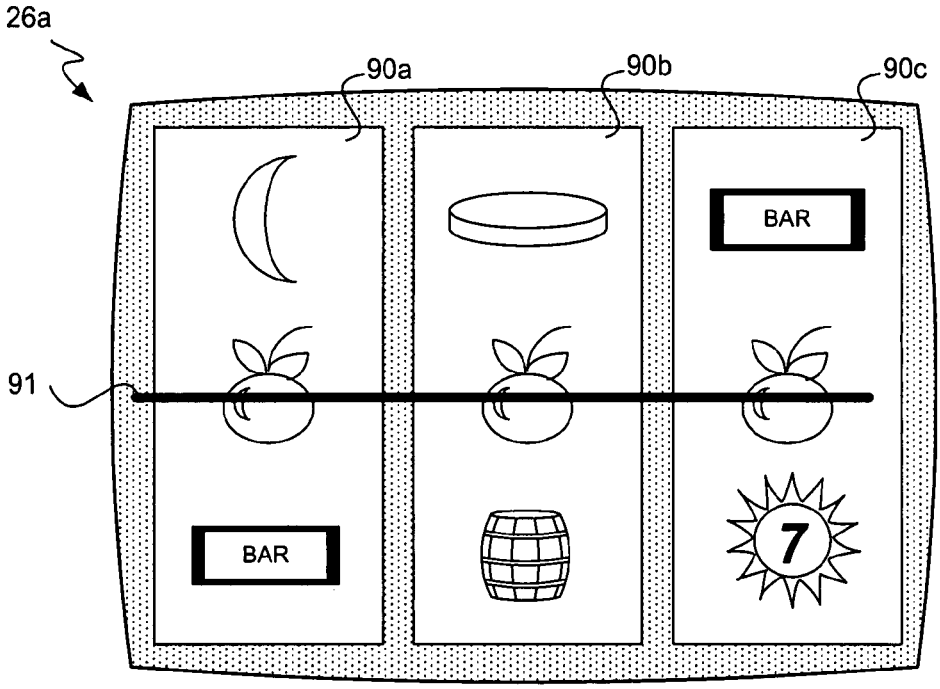
FIG. 3A illustrates in screen shot format an exemplary game outcome for a standard slots or reel type game having a single payline.
Figure 3B:
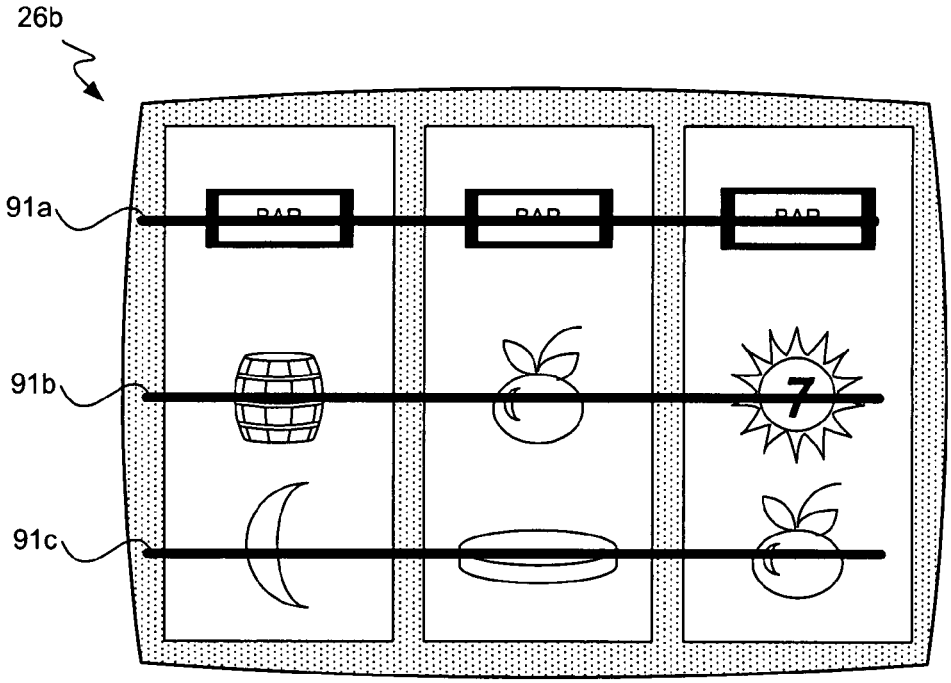
FIG. 3B illustrates in screen shot format another exemplary game outcome for a similar standard slots or reel type game having three paylines.

Turning next to FIGS. 3A and 3B, two exemplary screen shots showing reel type game results are provided. It will be readily appreciated that these screen shots could be taken from, for example, primary display 26 of gaming machine 10 from FIG. 1, as well as a variety of other types of screens or displays. For example, the reels shown in both screen shots can be graphical reels generated electronically, or can be actual physical reels. FIG. 2A illustrates a screen shot 26*a* of an exemplary game outcome for a standard slots style game having a single payline. Three distinct gaming reels 90*a*, 90*b*, 90*c* having various reel symbols thereupon are made to rotate either physically or through simulated rotation graphically after a player wager and upon a player initiation of a game play. As is generally known, after the reels stop, the symbols that fall along an appropriate payline can result in a monetary or other game award, depending upon the paytable used for the game. For example, in screen shot 26*b*, the game outcome along single payline 91 shows three consecutive cherries, which would likely result in an award. The other bar, moon, coin, barrel and lucky 7 symbols are not accounted for in this single payline game.

FIG. 3B illustrates a screen shot 26*b* of an exemplary game outcome for a standard slots style game having three paylines that are played simultaneously. Three distinct gaming reels having various reel symbols thereupon are again used, as in the previous example, only here there are three paylines 91*a*, 91*b*, 91*c*, where an appropriate combination of symbols across any or all of the three paylines could result in a monetary award or other win. For example, paylines 91*b* and 91*c* would likely not result in any kind of award, but the three bars across payline 91*a* would typically result in a significant award. Although general "winning" combinations have been shown for both of these examples, it will be readily appreciated that there are also many non-winning combinations of symbols for both the one payline and three payline games. It will also be readily appreciated that while the two brief examples illustrate games played with three reels, one or three paylines, and symbols such as cherries, bars, coins and the like, that many other games may be configured and similarly played with any number of reels, paylines and assorted types of reel symbols, including blank spaces as reel symbols.

Figure 4:
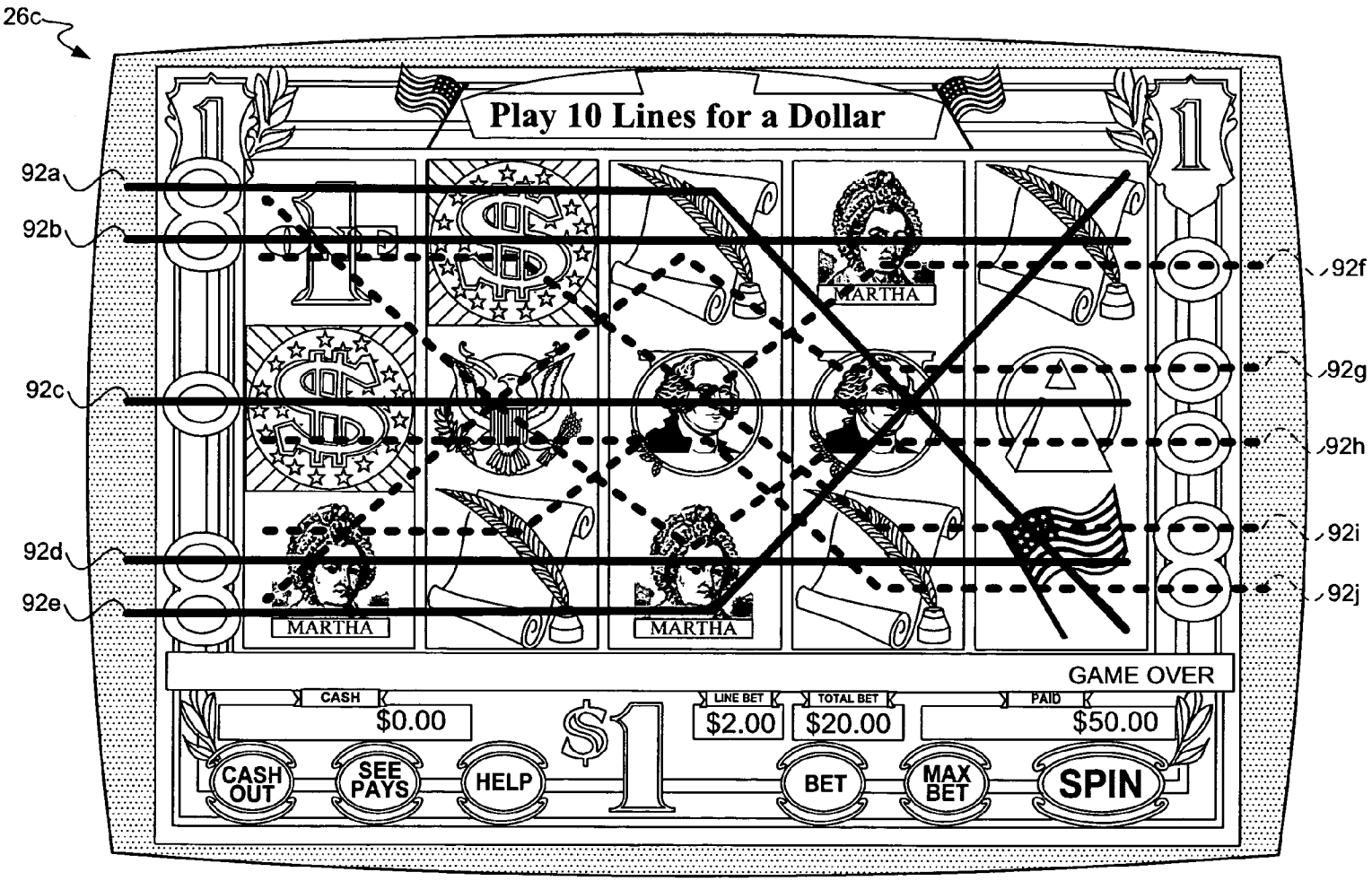
FIG. 4 illustrates in screen shot format yet another exemplary game outcome for a different slots or reel type game having ten paylines.

Continuing on to FIG. 4, yet another screen shot of an exemplary game outcome for a different slots style game having ten paylines is shown. Screen shot 26*c* actually depicts a game outcome for a "By George" virtual reel type game, and is used herein simply for purposes of illustration. As will be understood, elements of the game result in screen shot 26*c* are similar to those of the game results from screen shots 26*a* and 26*b* above. For example, there are a plurality of reels or simulated reels having reel symbols, various paylines, and combinations of symbols that can result in a win for a player. Notable differences include the number of reels, of which there are five, more detailed and themed reel symbols, and a notable increase in the number and complexity of paylines. Various additional graphical items and features are also included, as can be seen. Ten paylines 92*a*-92*j* are also available for play for any given reel type game played. For purposes of illustration and ease in following which lines cross which symbols, half of the paylines shown are solid lines, while the other five are broken lines. It will be understood that no significant distinction exists between the solid and broken lines.

It will be understood that the general payline applications described and illustrated with respect to FIGS. 3A and 3B utilize one-dimensional paylines, while the general payline applications described and illustrated with respect to FIG. 4 use both one-dimensional and two-dimensional paylines. The one-dimensional paylines generally extend in only one dimension (i.e., horizontally across the reels), while the two-dimensional paylines extend in both horizontal and vertical directions. Paylines 92*b*, 92*c* and 92*d* are examples of one-dimensional paylines, while paylines 92*a*, 92*e* and 92*f* are examples of two-dimensional paylines. Similar paylines may be used in the context of a plurality of gaming wheels, such as in the case of concentric gaming wheels. In such instances, a payline may similarly be a one-dimensional straight line, or a two-dimensional zig-zagging line, as will be readily appreciated.

Multi Layer Displays

Figure 5:
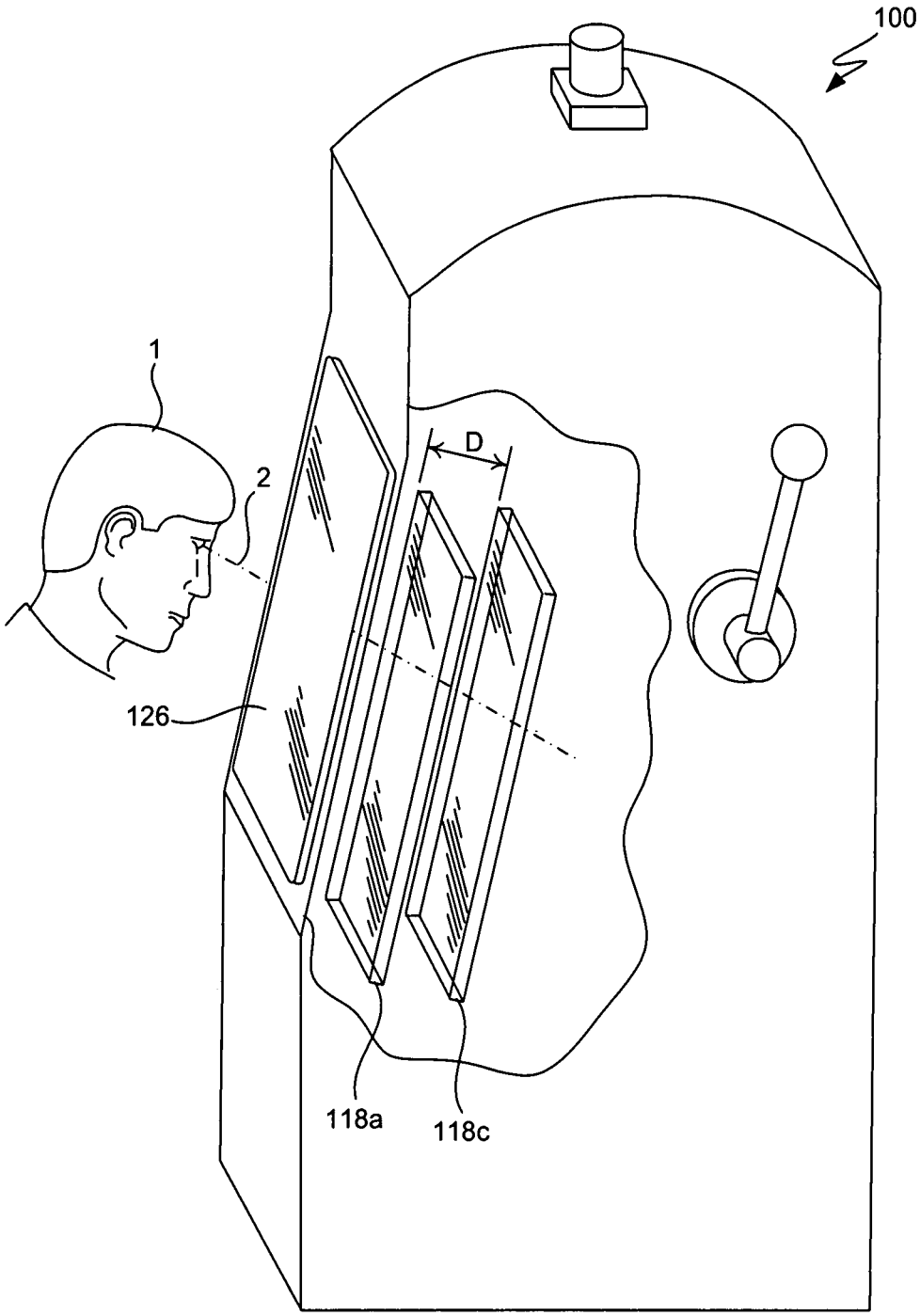
FIG. 5 illustrates in partial perspective and cut-away view an exemplary processor-based gaming machine having a multi-layer display according to one embodiment of the present invention.

Turning now to FIG. 5, an exemplary processor-based gaming machine having a multi-layer display according to one embodiment of the present invention is illustrated in partial perspective and cut-away view. Although the various gaming machines, devices, systems and methods involving more realistic emulations of physical reels and/or wheels set forth herein can be used on many types of processor-based gaming machines or systems, it is specifically contemplated that such devices and techniques can be applied to a gaming machine, terminal or system having a multi-layer display, such as multi-layer display gaming machine 100. It will be readily appreciated that multi-layer display gaming machine 100 can be substantially similar to processor-based gaming machine 10 described above, with the notable exception that a multi-layer display is installed within gaming machine 100.

Such multi-layer displays in a gaming machine can include, for example, those that are from or similar to commercially available products from PureDepth, Inc. of Redwood City, Calif. The PureDepth technology incorporates two or more LCD displays into a physical unit, where each LCD display is separately addressable to provide separate or coordinated images between the LCDs. Many PureDepth display systems include a high-brightened backlight, a rear image panel, such an active matrix color LCD, a diffuser, a refractor, and a front image plane; these devices are laminated to form a stack. The LCDs in these units are stacked at set distances, such as distance "D." As well as the binocular depth cue, PureDepth units feature intrinsic motion parallax, where the x and y distance changes between objects displayed on different video planes depending on viewing angle. In addition, separate focal planes may literally be brought in and out of focus depending on the focal length of the lens in the viewer's eye.

The layered display devices 118*a*, 118*c*, which may be layered LCD devices, for example, may be used in a variety of manners to output games on a gaming machine. In some cases, video data and images displayed on the display devices 118*a* and 118*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired.

Further, although described with respect to LCD screens or devices, it will be readily appreciated that other display technologies may also be adapted for use with respect to such multi-layer displays.

In a specific embodiment, display devices or screens 118*a* and 118*c* display co-acting or overlapping images to a person or viewer 1 looking at the display devices at a front display panel 126 and along a line-of-sight 2. For example, front display screen 118*a* may display paylines in transparent portions that illuminate winning combinations of reels disposed on back display screen 118*c*. With respect to further examples, it is again noted that external loading and changing of simulated reel games can be had with gaming machine 100, such as described above with respect to wager-based gaming system 50. This can permit a casino or gaming establishment to change video or visual images on each of the layered display devices, and their transparency, without physically altering the gaming machine or requiring maintenance. Thus, the number of virtual slot reels may be changed from 3 to 5 to 9, or some other number. In this case, each display device or screen 118*a*, 118*c* can change the position of its viewing window for viewing of the different number of virtual slot reels. Symbols on each virtual slot reel may also be changed. Also, a pay table shown on front display device 118*a* may be changed at will, in addition to changing whether a bonus or progressive game is shown on the back display device 118*c*, for example. This permits the same multi-layer display gaming machine 100 to play new games simply by downloading data onto the machine.

As will be readily appreciated, the layered display devices 118*a*, 118*c* may be used in a wide variety of manners to output games on a gaming machine. In some cases, video data and images displayed on the display devices 118*a* and 118*c* are positioned such that the images do not overlap, while in other instances, the images do overlap. It should also be appreciated that the images displayed on the display screen can fade-in fade out, pulsate, move between screens, and perform other inter-screen graphics to create additional affects, if desired. The multiple display devices may each display their own graphics and images, or cooperate to provide coordinated visual output. Objects and graphics in a game may then appear on any one or multiple of the display devices, where reels and other graphics on the front screen 118*a* blocks the view objects on the back screen 118*c*, depending on the position of the viewer relative to the screens. This provides actual perspective between the graphics objects, which represents a real-life component of 3D visualization.

In some embodiments, the multiple display screens or devices output video or other visual images for different games or purposes. For example, one display device may output a reel game, while another display device outputs a bonus game or pay table associated with the other display, while still another display device provides a progressive game or is reserved for player interaction and video output with a touchscreen. One or more display screens or devices may also present one or more gaming wheels, which may be shown as static, in motion, or preferably both at various times. Other combinations may be used, as may be desired. Furthermore, while the foregoing embodiment has been described with respect to only two screens, it will be readily appreciated that additional screens may also be used for such a multi-layer display. For example, a middle screen (not shown) can be disposed between front layered screen 118*a* and back layered screen 118*c*, with such a middle screen also being adapted for the presentation of a coordinated video presentation or other visual image to a viewer. Still further screens may also be implemented into the multi-layer stack, as desired.

Wager based games output by the display devices or screens in such a multi-layer display may include, for example, any video game emulation that portrays one or more reels. Typically, the gaming machine simulates the rotation of the video reels using motion graphics for the symbols on the reel strips and motion graphics for the mechanical components. In various particular embodiments, the use of multiple screens may be made to account for any special effects or more realistic simulations that are desired through the use of a multi-layer display. For example, reel symbols may be moved from a back display to a front display and then to the back display again as they appear to rotate or spin along their respective virtual reels. Such movement of reel symbols from one screen to another within a multi-layer display can aid in a more realistic emulation of physical mechanical reels on a processor-based gaming machine. Other details regarding the depiction of simulated reels on a multi-layer display can be found in U.S. patent application Ser. No. 11/858,695, filed on Sep. 20, 2007, and entitled "Realistic Video Reels," which application is incorporated herein by reference in its entirety and for all purposes.

Various embodiments of the present invention can involve a more realistic emulation of physical reels though additional visual techniques, which can be used on processor-based gaming machines having multi-layer displays as well as those having more traditional displays, such as a simple CRT, LCD, flat panel display, or the like. Such visual techniques can include varying the timings of reel spin lengths as well as successive reel stops, which timing variances may involve sampling the spins of actual physical reels and modeling virtual reel spin times and successive reel stop times after the sampled physical reel spins. Various levels of randomization may also be introduced into such reel spin and reel stop times, so as to more realistically simulate the slightly varying reel spin and reel stop times of actual physical reels. Instead of and/or in addition to gaming reels, similar techniques may be used in the presentation of one or more emulated spinning gaming wheels.

Various embodiments of the present invention can also involve a more realistic emulation of physical reels though added audio techniques, which audio techniques can be used separately or in combination with one or more of the above visual techniques. Such added audio techniques can include providing audio playback of actual sounds sampled and recorded from rotating physical reels, which replayed sounds can be selected from multiple and/or lengthier sound samplings from mechanical reels that are stored in an associated memory. A separate audio track can be implemented for each virtual reel, and such separate tracks can be directed for play at a plurality of speakers, which play can be stereophonic in nature. Variances in the audio playback can also be similarly randomized, so as to more realistically simulate the slightly varying sounds of actual physical reels in motion. Further details regarding the realistic emulation of reels in a processor-based gaming machine can be found at, for example, copending and commonly owned U.S. patent application Ser. No. 11/858,845 by Williams, et al, entitled "Multimedia Emulation of Physical Reel Hardware in Processor-Based Gaming Machines," which application is incorporated herein by reference in its entirety and for all purposes. It will be readily appreciated that various teachings of this reference with respect to the presentation of gaming reels can be correlated to the presentation of gaming wheels, as may be desired.

Three-Dimensional Payline Applications

Various embodiments of the present invention relate to the presentation of three-dimensional paylines, such as by way of one or more rotating or moving reels, wheels and/or the like, on one or more video or visual displays of a processor-based gaming machine. This can be accomplished at least in part through the use of a specialized multi-layer display, such as that which is illustrated in FIG. 5 and described herein. Such three-dimensional paylines can be made three-dimensional through a variety of approaches or applications, which approaches or applications may be used separately or in any suitable combination, as desired.

Under one application, a three-dimensional payline is created by providing payline reel-stops, wheel-stops or other suitable payline stops or designations on a plurality of display screens within an associated multi-layer display. The use of such stops on a plurality of display screens creates a depth component to the payline, such that the payline is then three-dimensional. In various embodiments using this approach, one or more three-dimensional paylines comprising lines having a horizontal component, a vertical component and a depth component are created with respect to a player of an associated game.

Figure 6A:
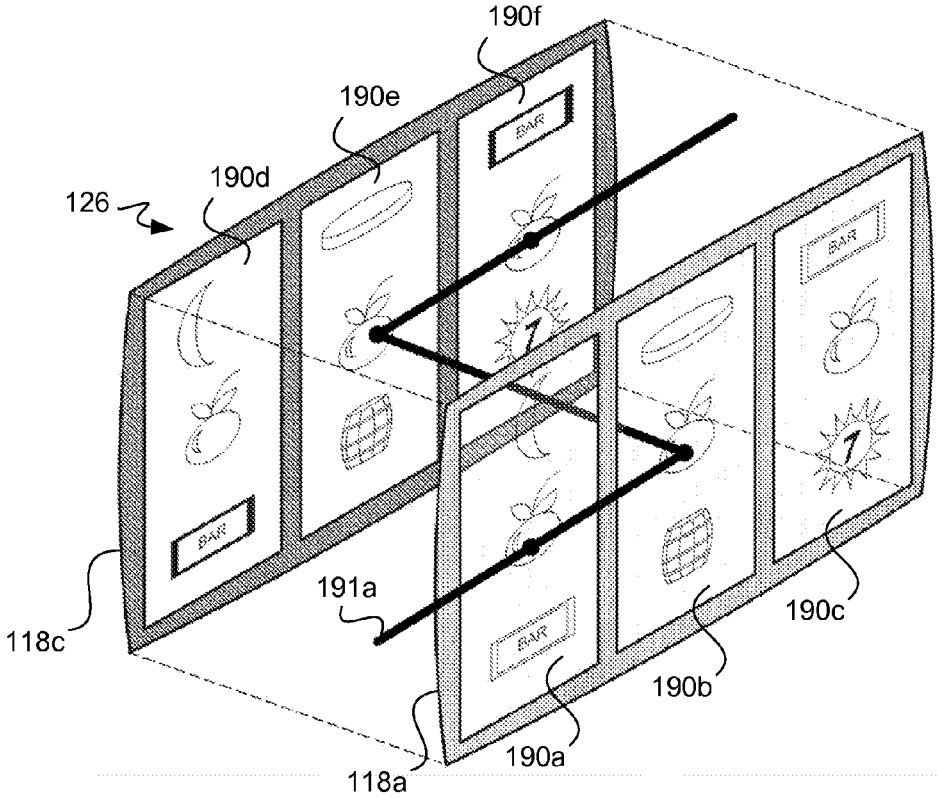
FIG. 6A illustrates in partially exploded front elevation view a simulated display of an exemplary three-dimensional payline having a horizontal component and a depth component according to one embodiment of the present invention.

Referring now to FIG. 6A, a simulated display of an exemplary three-dimensional payline having a horizontal component and a depth component according to one embodiment of the present invention is illustrated in partially exploded front elevation view. Multi-layer display 126 includes presentations or displays made on a front display screen 118*a* and back display screen 118*c* from a multi-layer display device, such as that which is illustrated in FIG. 5 and described herein. Front virtual reels 190*a*, 190*b* and 190*c* are presented on front display screen 118*a*, while back virtual reels 190*d*, 190*e* and 190*f* are presented on back display screen 118*c*. Additional display screens (e.g., a middle display screen) having more virtual reels may also be used, as will be readily appreciated.

As in the case of many multi-layer display applications, each of virtual reels 190*a*-190*f* can be at least partially transparent or translucent, such that all virtual reels and the various reel symbols and reel stops thereon may be readily viewed by a player. For purposes of illustration and ease of understanding, the reel symbols shown on each of back virtual reels 190*d*, 190*e* and 190*f* are identical to the reel symbols shown on front virtual reels 190*a*, 190*b* and 190*c*. However, it will be readily appreciated that such identical placement of reel symbols on corresponding front and back virtual reels need not take place, and that a wide variety of other reel symbols and/or reel symbol orders or sequences might also be used.

As shown, three-dimensional payline 191*a* begins at the cherry reel symbol of front virtual reel 190*a*, and then moves or extends horizontally to the cherry reel symbol of front virtual reel 190*b*. At this point, three dimensional payline 191*a* extends or "jumps" into the screen (i.e., depthwise) from the front screen to the back screen to arrive at the cherry reel symbol of back virtual reel 190*e*. From this point, three-dimensional payline 191*a* then moves or extends horizontally to the cherry reel symbol of back virtual reel 190*f*, at which point the three-dimensional payline then ends. Although the three-dimensional payline 191*a* only extends or jumps once from one display screen to another, it will be readily appreciated that additional extensions, moves or jumps between display screens may also be added for a given three-dimensional payline. Because three-dimensional payline 191*a* moves only in horizontal and depthwise directions, and does not extend above or below a general center line of the overall display, this three-dimensional payline might not be considered to have a vertical component.

Figure 6B:
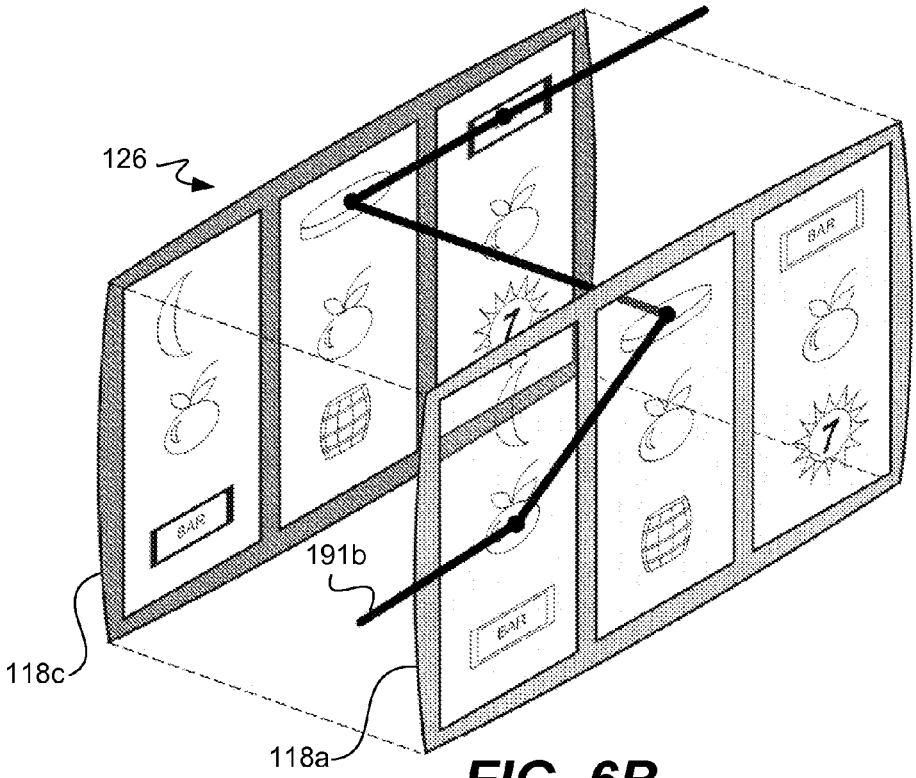
FIG. 6B illustrates in partially exploded front elevation view a simulated display of an alternative exemplary three-dimensional payline having horizontal, vertical and depth components according to another embodiment of the present invention.

Moving next to FIG. 6B, a simulated display of an alternative exemplary three-dimensional payline having horizontal, vertical and depth components according to another embodiment of the present invention is similarly illustrated in partially exploded front elevation view. Similar to the foregoing embodiment, multi-layer display 126 includes presentations or displays made on a front display screen 118*a* and back display screen 118*c* from a multi-layer display device. Front virtual reels are presented on front display screen 118*a*, while back virtual reels are presented on back display screen 118*c*, and these virtual reels and reel symbols are identical to those of FIG. 6B for purposes of illustration.

As shown, three-dimensional payline 191*b* begins at the cherry reel symbol of the first front virtual reel, then moves diagonally onward to the coin reel symbol of the second front virtual reel, then extends or jumps depthwise to the coin reel symbol of the second back virtual reel, and then finally extends horizontally to the bar reel symbol of the third back virtual reel. Because three-dimensional payline 191*b* moves horizontally across reels, moves vertically away from an initial start level or position, and also moves depthwise into or out from a multi-layer display screen, this three-dimensional payline definitely includes horizontal, depth and vertical components.

As will be readily appreciated, a given reel type wager-based game may include both of three-dimensional paylines 191*a* and 191*b* in the same game play. Additional three-dimensional paylines may also be devised and included in the same game play and/or other separate game plays. Such additional three-dimensional paylines may be numerous in nature, and may resemble the many paylines of FIG. 4, or may be even more complex and/or numerous. Furthermore, any number of reels or wheels may be used for such three-dimensional paylines. For example, five virtual reels on each display screen may be a suitable number of virtual reels for a more robust reel type game having three-dimensional paylines. In addition, while the three-dimensional paylines 191*a* and 191*b* are shown to have depth extensions, movements or "jumps" between screens at the same location, it will be readily appreciated that such jumps may take place between locations on screens that are atop one another. For example, payline 191*a* might alternatively jump directly from the cherry reel symbol at virtual reel 190*b* to the cherry reel symbol at virtual reel 190*f*.

One feature that is raised by the use of such three-dimensional paylines that jump depthwise from one location to another is the ability of a payline to have more stops than the number of reels that are shown for a given reel type game. As shown in the illustrative examples of FIGS. 6A and 6B, the provided reel type game uses sets of three virtual reels. Traditionally, the use of three gaming reels would result in paylines having exactly three reel stops or components. As shown in these examples, however, three-dimensional paylines 191*a* and 191*b* can involve four reel stops each. As such, the use of paylines having more reel stops than the number of reels in a reel set can be readily facilitated by way of the disclosed three-dimensional paylines. In fact, a given game may include paylines having varying lengths. That is, one or both of three-dimensional and four-stop paylines 191*a*, 191*b* may be provided in a given game that also includes one or more traditional three-stop paylines that extend across only one of display screens 118*a* or 118*c*. Further variations involving multiple extensions jumps between screens can similarly result in three-dimensional paylines having five stops or more.

Figure 7A:
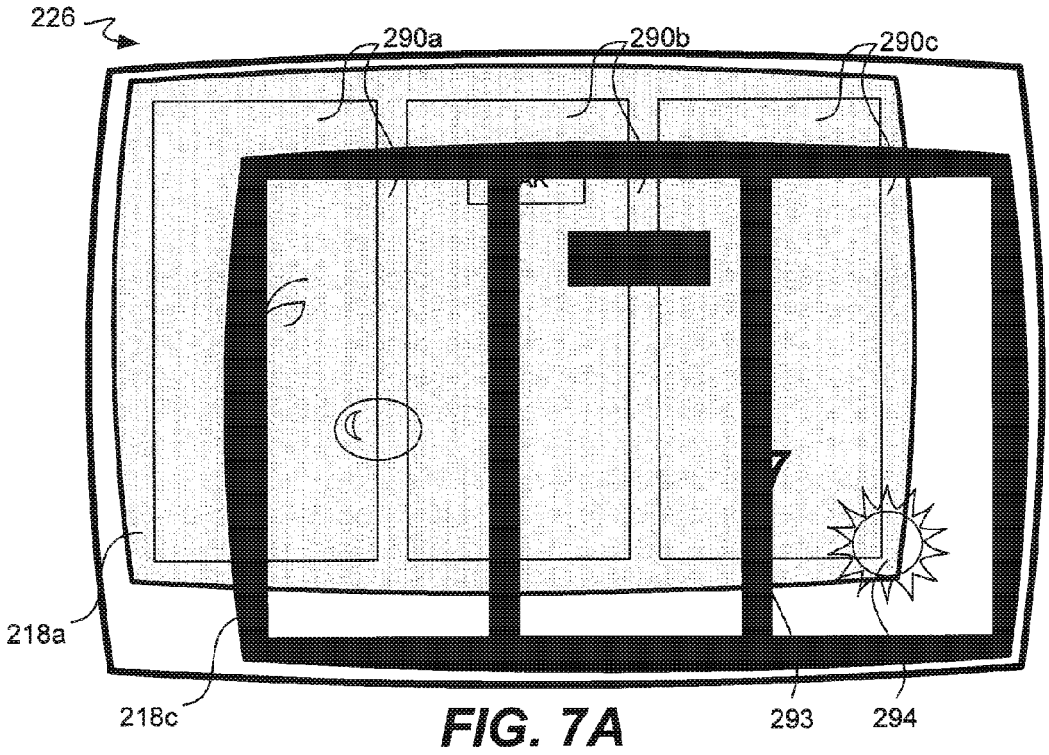
FIG. 7A illustrates in partially exploded front elevation view a simulated display of three exemplary composite reel symbols having symbol portions on separate display screens according to one embodiment of the present invention.

Under another application, a three-dimensional payline is created by providing one or more composite symbols on a plurality of display screens in an associated multi-layer display. The use of such composite symbols creates three-dimensional symbols along a payline, such that the payline is then three-dimensional. FIG. 7A illustrates in partially exploded front elevation view a simulated display of three exemplary composite reels symbol having symbol portions on separate display screens according to one embodiment of the present invention. Multi-layer display 226 includes a front display screen 218*a* and back display screen 218*c*, with each display screen presenting portions of virtual reels 290*a*, 290*b* and 290*c*. Unlike the foregoing embodiments of FIGS. 6A and 6B, each display screen does not display its own set of virtual reels. Rather, the displays of both screens are used in combination to create composite reel symbols on virtual reels, which may also be composite in nature. Such an arrangement may be adapted to take advantage of the various properties of a multi-layer display to present reels and/or reel symbols that appear to be three-dimensional in nature.

Although it will be readily appreciated that a greater number of composite reel symbols may be presented on virtual reels 290*a*, 290*b*, 290*c*, only three such composite reel symbols are shown in FIG. 7A for ease of illustration and clarity. As shown, virtual reel 290*a* includes a composite cherry reel symbol, virtual reel 290*b* includes a composite bar reel symbol, and virtual reel 290*c* includes a composite shining "lucky 7" reel symbol. For each of these composite reel symbols, a portion of the symbol is presented on display screen 218*a*, while another portion of the symbol is presented on display screen 218*c*. The resulting display of a composite reel symbol is then three-dimensional in nature, and can generally be more appealing to players. Added effects may also be provided, such as the rapid alternating of which screen each reel symbol portion is displayed upon, with such alternating displays resulting in a pulsating composite reel symbol, for example. Such added effects may be used in the event that a composite reel symbol is to be highlighted for any reason, such as, for example, the highlighting of a winning three-dimensional payline.

Figure 7B:
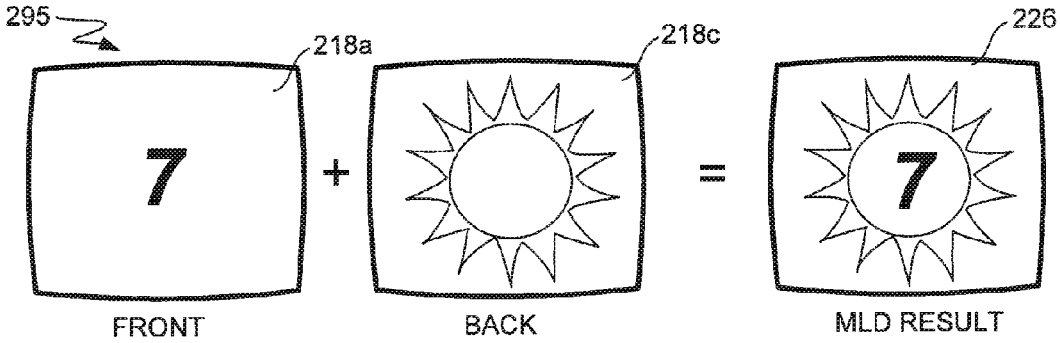
FIG. 7B illustrates an exemplary set of partial front screen, back screen and resulting combination screen presentations that can be used to form the shining "lucky 7" composite reel symbol of FIG. 7A.

Continuing to FIG. 7B, an exemplary set of partial front screen, back screen and resulting combination screen presentations that can be used to form the shining "lucky 7" composite reel symbol of FIG. 7A are illustrated. Screen set 295 includes partial front screen 218*a*, partial back screen 218*c* and a resulting partial multi-layer display 226. As shown, a reel symbol portion of only the number "7" is presented on the front screen 218*a*, while the remaining sun or highlighting reel symbol portion is presented on the back screen 218*c*. The MLD result is a three-dimensional composite reel symbol of a shining "lucky 7." Similar representations may be made for each of the cherry and bar composite reel symbols shown in FIG. 7A, and it will be readily appreciated that a wide variety of other reel symbols may similarly be separated into symbol portions that can be displayed on a plurality of screens in a multi-layer display, so as to form composite reel symbols that are three-dimensional in nature.

Under yet another application, a three-dimensional payline is created by providing a plurality of virtual reels or wheels on one display screen of an associated multi-layer display, while also providing on a separate display screen of the multi-layer display one or more additional game designations that are used with respect to the plurality of virtual reels or wheels within the context of said wager-based game. The use of such additional game designations on a separate screen in the same multi-layer display creates three-dimensional effects along a payline, such that the payline is then three-dimensional.

Figure 7C:
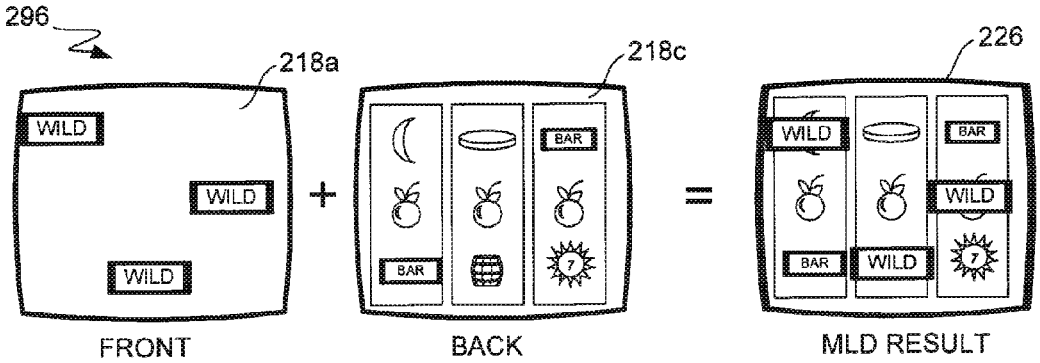
FIG. 7C illustrates one exemplary set of front screen, back screen and resulting combination screen presentations that can be used to form an alternative simulated display of virtual gaming reels that are used in conjunction with additional game designations on a separate display screen according to another embodiment of the present invention.

Moving next to FIG. 7C, such an application is shown in the form of one exemplary set of front screen, back screen and resulting combination screen presentations that can be used to form an alternative simulated display of virtual gaming reels that are used in conjunction with additional game designations on a separate display screen. As shown in this particular screen set application 296, a front screen 218*a* is used to provide one or more additional game designations to go with the virtual reels presented on back screen 218*c*. The combination of front screen 218*a* and back screen 218*c* results in a single visual presentation or "MLD result" that is provided on multi-layer display 226. In this particular illustration, the additional game designations on front screen 218*a* are added "wild" bars that can be used in the place of an overlaid reel symbol on back screen 218*c*. When used, such "wild" bar designations serve to replace the overlaid reel symbol with a wild bar or other similar symbol that can be any or almost any other reel symbol for that given game, with the use of such wild symbols being generally well known in the art.

As will be readily appreciated, such additional game designations might be any of a variety of other items, such as, for example, an award "multiplier" and/or bonus game provision or trigger. An award multiplier can result in, for example, any payline that includes the affected reel symbol having any applicable win or payout for that game be multiplied by the provided multiplier number. A bonus game trigger can involve, for example, an overlaid symbol or designation that results in the award of a bonus game if the affected underlying reel symbol is the right type of reel symbol. In general, the overlay of a sheet or screen of additional game designations can result in an exciting three-dimensional presentation atop a reel type or wheel type wager-based game. Such additional game designations can be made to animate and/or interact with any affected underlying reel symbols, so as to provide a more entertaining experience for a player.

In various versions of such an additional game designation embodiment, such additional game designations may require an added payment or wager by the player in order for such additional game designations to be active or take effect. For example, the "wild" bars of screen set application 296 may be inactive if a player does not add an extra wager or otherwise pay for them. In such instances where an added payment or wager is required and not paid, then the underlying game may simply be played as usual. In such instances, the additional game designations may or may not be shown. If shown, such additional game designations can be provided in a lightened or "ghost" form, such that the player can see what he or she might have won if such additional game designations had been paid for. Further additional game designations having other functions may also be provided, and such additional game designations may be provided alone or in combination with each other, as desired. For example, a given game might include an optional payment or wager for "wild" bars, another optional payment or wager for "multiplier" designations, and still another optional payment or wager for "bonus" designations. In the event that a player pays for all three of these items, then a front display having one or more of each active item may be generated for a respective game play.

Method of Use

It will be readily appreciated that the method and illustrative flowchart provided herein are merely exemplary, and that the present invention may be practiced in a wide variety of suitable ways. While the provided flowchart may be comprehensive in some respects, it will be readily understood that not every step provided is necessary, that other steps can be included, and that the order of steps might be rearranged as desired by a given manufacturer, as desired.

Figure 8:
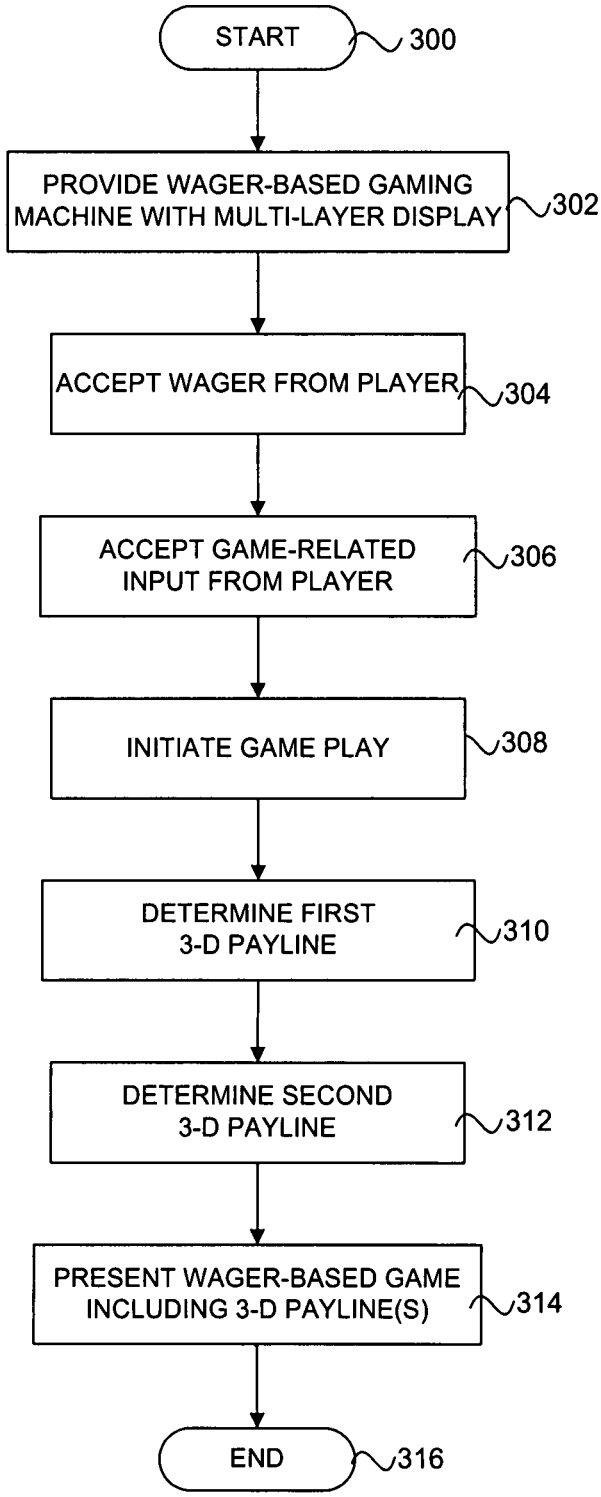
FIG. 8 illustrates a flowchart illustrating one exemplary method of presenting a three-dimensional payline on a processor-based gaming machine according to one embodiment of the present invention.

Specifically, FIG. 8 illustrates a flowchart illustrating one exemplary method of presenting a three-dimensional payline on a processor-based gaming machine according to one embodiment of the present invention. Such a method serves to illustrate an automated process whereby a wager-based game using a three-dimensional payline is administered and presented. After start step 300, a first process step 302 involves providing a wager-based gaming machine having a multi-layer display. Such a gaming machine can be any of the exemplary gaming machines as described above. Process step 304 then involves accepting a wager from the player, process step 306 involves accepting a game related input from the player, and a game play is then initiated at process step 308.

After game play is initiated at step 308, a first three-dimensional payline is determined at process step 310. A second three-dimensional payline may then be determined at process step 312, and it will be readily appreciated that further three-dimensional paylines may also be determined, as may be appropriate given the particular game played. Such payline determinations can involve a number of factors, including one or more default settings and/or one or more settings or selections made by the player of the game. In addition, one or more of such three-dimensional payline determinations may be made at another time, such as after the game related input is accepted from the player at step 306.

The method then moves to process step 314, where the wager-based game including one or more three-dimensional paylines is presented. The method then finishes at end step 316. Of course, additional steps may also apply to such a process, as may be desired. Such steps may include, for example, the determination of whether a game outcome is a winning outcome, as well as the award of a monetary payment to the player in the event of such a winning outcome.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A processor-based gaming machine configured to accept a wager, play a game based on the wager, and grant a payout, comprising:

an exterior housing arranged to contain a plurality of internal gaming machine components therein;

a master gaming controller in communication with at least one of said plurality of internal gaming machine components and configured to execute or control one or more aspects of said wager-based game; and a multi-layer display device in communication with said master gaming controller and configured to display a first three-dimensional winning payline thereupon, wherein said payout is granted in response to the display of said first three-dimensional winning payline, and wherein said multi-layer display device includes:

at least one display controller configured to generate or transmit one or more display signals, a first display screen in communication with said at least one display controller and configured to present a first visual display thereupon based on said one or more display signals, and a second display screen in communication with said at least one display controller and configured to present a second visual display thereupon based upon said one or more display signals, said second display screen being positioned behind said first display screen such that said first and second visual displays are configured to combine for a single visual presentation that includes said first three-dimensional winning payline to a player of said wager-based game, wherein said at least one display controller is further configured to:

generate said first three-dimensional winning payline, and emphasize said first three-dimensional winning payline by causing said first three-dimensional winning payline to visually jump between said second display screen and said first display screen at least once.

2. The processor-based gaming machine of claim 1, further including:

one or more speakers in communication with said master gaming controller and adapted to present sounds with respect to said first three-dimensional winning payline.

3. The processor-based gaming machine of claim 1, further including:

a network interface coupling said gaming machine to one or more remotely located networked components, said network interface adapted to facilitate the downloading of three-dimensional payline parameters, three-dimensional payline games, or both to said processor-based gaming machine.

4. The processor-based gaming machine of claim 1, wherein said multi-layer display device is further adapted to display a second three-dimensional winning payline thereupon simultaneously with the display of said first three-dimensional winning payline, wherein said second three-dimensional winning payline comprises indicia, said indicia comprising symbols, symbol portions, stops, designations or any combination thereof, at least one of which is displayed on said first display screen and at least another of which is disposed on said second display screen.

5. The processor-based gaming machine of claim 1, wherein said first three-dimensional winning payline includes at least one composite indicium, said at least one composite indicium comprising a first indicium portion displayed on said first display screen and a second indicium portion displayed on said second display screen to form a combined indicium having a three-dimensional effect.

6. The processor-based gaming machine of claim 4, wherein said second three-dimensional winning payline includes at least one second composite indicium, said at least one second composite indicium comprising a second first indicium portion displayed on said first display screen and a second second indicium portion displayed on said second display screen to form a second combined indicium having a three-dimensional effect.

7. A method of presenting a three-dimensional winning payline, comprising:

providing a wager-based gaming machine having a multi-layer display device that includes a first display screen adapted to present a first visual display thereupon and a second display screen adapted to present a second visual display thereupon, said second display screen being positioned behind said first display screen such that said first and second visual displays are adapted to combine for a single visual presentation;

accepting a monetary value wager from a player;

accepting a game-related input from said player;

initiating the play of a wager-based game as a result of said game-related input;

determining a first three-dimensional winning payline for use with said wager-based game;

presenting on said multi-layer display the play of said wager-based game including said first three-dimensional winning payline; and emphasizing said first three-dimensional winning payline by causing said first three-dimensional winning payline to visually jump between said second display screen and said first display screen at least once.

8. The method of claim 7, further comprising the step of:

determining a second three-dimensional winning payline for use with said wager-based game, wherein said second three-dimensional winning payline comprises indicia, said indicia comprising symbols, symbol portions, stops, designations or any combination thereof, at least one of which is displayed on said first display screen and at least another of which is disposed on said second display screen.

9. A wager-based gaming system, comprising:

a plurality of processor-based gaming machines adapted for accepting a wager, playing a game based on the wager and granting a payout, each of said plurality of processor-based gaming machines including:

an exterior housing arranged to contain a plurality of internal gaming machine components therein, a master gaming controller in communication with at least one of said plurality of internal gaming machine components and adapted to execute or control one or more aspects of said wager-based game, and a multi-layer display device in communication with said master gaming controller and adapted to display a first three-dimensional winning payline thereupon, wherein said payout is granted in response to the display of said first three-dimensional winning payline, wherein said multi-layer display device includes a first display screen adapted to present a first visual display and a second display screen adapted to present a second visual display, said second display screen being positioned behind said first display screen such that said first and second visual displays are adapted to combine for a single visual presentation that includes said first three-dimensional winning payline, wherein said first three-dimensional winning payline visually jumps between said second display screen and said first display screen at least once;

and a remote host in communication with said plurality of processor-based gaming machines, said remote host being adapted to download one or more three-dimensional payline parameters, three-dimensional payline games, or both, to one or more of said plurality of processor-based gaming machines.

* * * * *